US005380175A

United States Patent [19]

Amarume

[11] Patent Number: 5,380,175

[45] Date of Patent: Jan. 10, 1995

[54] FLUID FEED PUMP WITH VALVED PISTON DEVICE

[75] Inventor: Katsushi Amarume, Ebina, Japan

[73] Assignee: Fuji Xerox, Tokyo, Japan

[21] Appl. No.: 111,554

[22] Filed: Aug. 25, 1993

[30] Foreign Application Priority Data

Sep. 2, 1992 [JP] Japan ..... 4-234807

[51] Int. Cl.[6] ..... F04B 21/04

[52] U.S. Cl. ..... 417/553; 417/555.1

[58] Field of Search ..... 417/524, 525, 526, 545, 417/546, 553, 555.1

[56] References Cited

U.S. PATENT DOCUMENTS

| | | | |
|---|---|---|---|
| 176,330 | 4/1876 | Malmquist | 417/553 |
| 2,689,533 | 9/1954 | Ericson | 417/555.1 |
| 3,752,604 | 8/1973 | Dorn | 417/553 |
| 3,904,325 | 9/1975 | Olofsson et al. | 417/524 |
| 4,975,028 | 12/1990 | Schultz | 417/553 |
| 5,102,052 | 4/1992 | Demarest et al. | 417/526 |

FOREIGN PATENT DOCUMENTS

| | | | |
|---|---|---|---|
| 1181664 | 1/1959 | France | 417/546 |
| 39981 | 3/1984 | Japan | 417/553 |
| 3-5160 | 1/1991 | Japan . | |
| 308083 | 1/1953 | Switzerland | 417/553 |

*Primary Examiner*—Richard A. Bertsch
*Assistant Examiner*—Roland G. McAndrews, Jr.
*Attorney, Agent, or Firm*—Oliff & Berridge

[57] ABSTRACT

A fluid feed pump which prevents fluid from leaking or flowing back from a discharging side section into a suction side section when fluid sucked into the pump from the suction side section is to be fed into the discharging side section is disclosed. When a piston in a cylinder moves in a sucking/discharging direction, fluid flows into an inlet port side section in the inside of the cylinder through an inlet port while the inlet port side section and an outlet port side section of the inside of the cylinder are separated in an axial direction by a tubular enclosing member. Thereupon, since a lower portion of the tubular enclosing member is expanded in a radial direction to contact an outer circumferential face thereof in a water-tight condition with the inner face of the cylinder, the inlet and outlet port side sections of the cylinder are isolated in a high sealing condition from each other. Since the piston moves in the sucking/discharging direction while the inside of the cylinder is in the condition wherein the inlet and port side sections thereof are isolated from each other, fluid in the outlet port side section in the inside of the cylinder does not flow into the inlet port side section.

4 Claims, 2 Drawing Sheets

FLUID FEED PUMP WITH VALVED PISTON DEVICE

BACKGROUND OF THE INVENTION

1. Field of the Invention

This invention relates to a pump for feeding fluid at a low flow rate, and more particularly to a fluid feed pump which is suitable for use at a location with a small installation space and can be constructed in a small size.

2. Description of the Related Art

Ink suction pumps (fluid feed pumps) employed in conventional ink jet recording apparatus are formed as pumps of a small size in order to save the installation space. An exemplary one of such space-saving ink suction pumps is disclosed in Japanese Patent Laid-Open Application No. Heisei 3-5160. The ink suction pump disclosed in this document includes a cylinder, a piston disposed in the cylinder and having a piston shaft passing hole formed therein with a seal rib provided at an end face in an axial direction thereof. A piston shaft extends through the piston shaft passing hole and has a piston holder and a piston receiver disposed in a mutually opposing, predetermined spaced relationship from each other on a face of the piston on which the seal rib is provided and another face on the opposite side, respectively.

When the piston shaft is moved in a direction in which the piston holder pushes the piston, ink is sucked into a pump chamber in the cylinder, but when the piston shaft is moved in the opposite direction, the formerly sucked ink is discharged through the piston shaft passing hole.

While the conventional ink suction pump described above is constructed such that a valve function is provided by the end face of the piston on which the seal rib is provided and an end face of the piston holder disposed in an opposing relationship to the end face of the piston, the structure for realizing the valve function and the construction of inlet and outlet paths for ink are complicated. If the sealing performance between an outer circumferential face of the piston holder and an inner face of the cylinder which separate the inside of the cylinder into a suction side section and a discharge side section drops, then when fluid sucked from the suction side section into the pump is to be fed into the discharging side section, fluid in the discharging side section may leak into the suction side section, resulting in failure to obtain a sufficient sucking force. If it is tried to enhance the sealing property, then the problem arises that the frictional resistance between the outer circumferential face of the piston holder and the inner face of the cylinder is increased.

The ink suction pump for the ink jet recording apparatus is required to have a simplified construction and provide a sufficient sucking force.

SUMMARY OF THE INVENTION

It is an object of the present invention to provide a fluid feed pump which is simple in construction, easy to produce and small in size to save space.

It is another object of the present invention to provide a fluid feed pump which is sufficiently high in sealing performance to prevent fluid from leaking (flowing back) from a discharge side section into a suction side section of the inside of a cylinder when fluid sucked into the pump from the suction side section is to be fed into the discharge side section.

In order to attain the objects described above, according to the present invention, there is provided a fluid feed pump, which comprises a cylinder having an inlet port and an outlet port formed at one and the other end portions thereof, respectively, and defining a piston accommodating chamber therein between the inlet port and the outlet port. A piston has a suction/discharge contacting portion and a fluid moving contacting portion disposed in a spaced relationship from each other in an axial direction thereof and fitted in the cylinder for back and forth movement in a sucking/discharging direction and a fluid moving direction opposite to the sucking/discharging direction. A tubular enclosing member is disposed between an outer face of the piston and an inner face of the cylinder between the suction/discharge contacting portion and the fluid moving contacting portion for movement in the sucking/discharging direction together with the piston in a condition wherein the tubular enclosing member remains in contact with the suction/discharge contacting portion and in the fluid moving direction together with the piston in another condition wherein the tubular enclosing member remains in contact with the fluid moving contacting portion, the tubular enclosing member being so shaped that, when it moves in the sucking/discharging direction in the condition wherein it remains in contact with the suction/discharge contacting portion, it is expanded in a radial direction so that the outer circumferential face and the inner circumferential face thereof contact in a water-tight condition with the inner face of the cylinder and the outer circumferential face of the piston, respectively. A fluid movement controlling means is provided for establishing communication between the opposite sides of the enclosing member in the axial direction in the inside of the cylinder when the tubular enclosing member is in the condition wherein it contacts with the fluid moving contacting portion of the piston. A check valve is provided for allowing, when the piston moves in the sucking/discharging direction, movement of fluid into the piston accommodating chamber of the cylinder through the inlet port and for preventing, when the piston moves in the fluid moving direction, fluid from flowing through the inlet port.

In the fluid feed pump, the inlet port is provided at one end portion of the piston accommodating chamber of the cylinder, and the outlet port is provided at the other end portion of the piston accommodating chamber. The piston accommodated in the piston accommodating chamber is moved back and forth in the sucking/discharging direction and the fluid moving direction which is opposite to the sucking/discharging direction. The piston thus disposed for back and forth movement has the suction/discharge contacting portion and the fluid moving contacting portion disposed in a spaced relationship from each other in the axial direction thereof.

The tubular enclosing member is disposed between the outer face of the piston and the inner face of the cylinder between the two contacting portions. The tubular enclosing member is moved between the position in which it contacts with the suction/discharge contacting portion of the piston and the other position in which it contacts with the fluid moving contacting portion. The tubular enclosing member moves in the sucking/discharging direction together with the piston in the condition wherein it remains in contact with the suction/discharge contacting portion, and moves in the fluid moving direction together with the piston in the condition wherein it remains in contact with the fluid moving contacting portion. When the tubular enclosing member moves in the sucking/discharging direction in the condition wherein it remains in contact with the suction/discharge contacting portion of the piston, a lower portion of it is expanded in a radial direction so that the outer circumferential face thereof contacts in a water-tight condition with the inner face of the cylinder.

On the other hand, when the tubular enclosing member is in the condition wherein it contacts with the suction/discharge contacting portion of the piston, the fluid movement controlling means isolates the opposite sides of the enclosing member in the inside of the cylinder in the axial direction from each other, but when the tubular enclosing member is in the condition wherein it contacts with the fluid moving contacting portion of the piston, the fluid movement controlling means establishes communication between the opposite sides of the enclosing member in the axial direction in the inside of the cylinder.

The check valve allows, when the piston moves in the sucking/discharging direction, movement of fluid into the piston accommodating chamber of the cylinder through the inlet port, but prevents, when the piston moves in the fluid moving direction, fluid from flowing through the inlet port.

Accordingly, when the piston in the cylinder is moved in the sucking/discharging direction, fluid flows into the section of the inside of the cylinder adjacent the inlet port through the inlet port. In this instance, the opposite sides of the enclosing member in the inside of the cylinder are isolated from each other in the axial direction by the enclosing member. Besides, in this instance, since the tubular enclosing member is expanded in a radial direction so that the outer circumferential face thereof contacts in a watertight condition with the inner face of the cylinder, the section adjacent the inlet port and the other section adjacent the outlet port in the inside of the cylinder are isolated in a high sealing condition from each other. Since movement of the piston in the sucking/discharging direction is performed in the condition wherein the section adjacent the inlet port and the other section adjacent the outlet port in the inside of the cylinder are isolated from each other as described above, the fluid in the outlet side section in the inside of the cylinder will not move back into the inlet side section. Consequently, the efficiency of the pump is not deteriorated at all.

The fluid movement controlling means may be constituted from a surface of the piston which contacts in a fluid-tight condition with the inner face of the enclosing member when the enclosing member is in the condition wherein it contacts with the suction/discharge contacting portion of the piston and which has a fluid moving groove which forms a gap between the surface of the piston and the inner face of the enclosing member when the tubular enclosing member is in the condition wherein the tubular enclosing member contacts with the fluid moving contacting portion of the piston.

When the tubular enclosing member is in the condition wherein it contacts with the suction/discharge contacting portion of the piston, the inner face of the enclosing member and the surface of the piston contact in a fluid-tight condition with each other. If the piston is moved in the sucking/discharging direction in this condition, then fluid is sucked into the section adjacent the inlet port in the inside of the cylinder, and fluid in the other section adjacent the outlet port in the inside of the cylinder is discharged through the outlet port.

On the other hand, when the tubular enclosing member is in the condition wherein it contacts with the fluid moving contacting portion of the piston, a gap is formed between the inner face of the enclosing member and the fluid moving groove on the surface of the piston. If the piston is moved in the opposite direction to the sucking/discharging direction, that is, in the fluid moving direction, then fluid in the section adjacent the inlet port in the cylinder moves into the other section adjacent the outlet port in the inside of the cylinder through the fluid moving groove.

The check valve may be disposed between the inlet port and the piston accommodating chamber of the cylinder. The arrangement of the check valve making use of the chamber of the cylinder is effective to simplify the construction.

The inlet port may be connected to the inside of a cap which contacts with an ink jet recording head at an ink discharging opening of the ink jet recording head to enclose the ink discharging opening. Where the inlet port is connected to the inside of the cap, initial filling of ink into an ink nozzle of the ink jet recording apparatus and recovering processing for discharging of ink can be performed with certainty.

In summary, according to the present invention, a fluid feed pump is provided which is simplified in construction, easy to produce and small in size to save space.

Further, when fluid sucked into the pump from the inlet side is to be fed to the outlet side, fluid in the outlet side section can be prevented from leaking or flowing back into the inlet side section.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENT

Figure 1A:
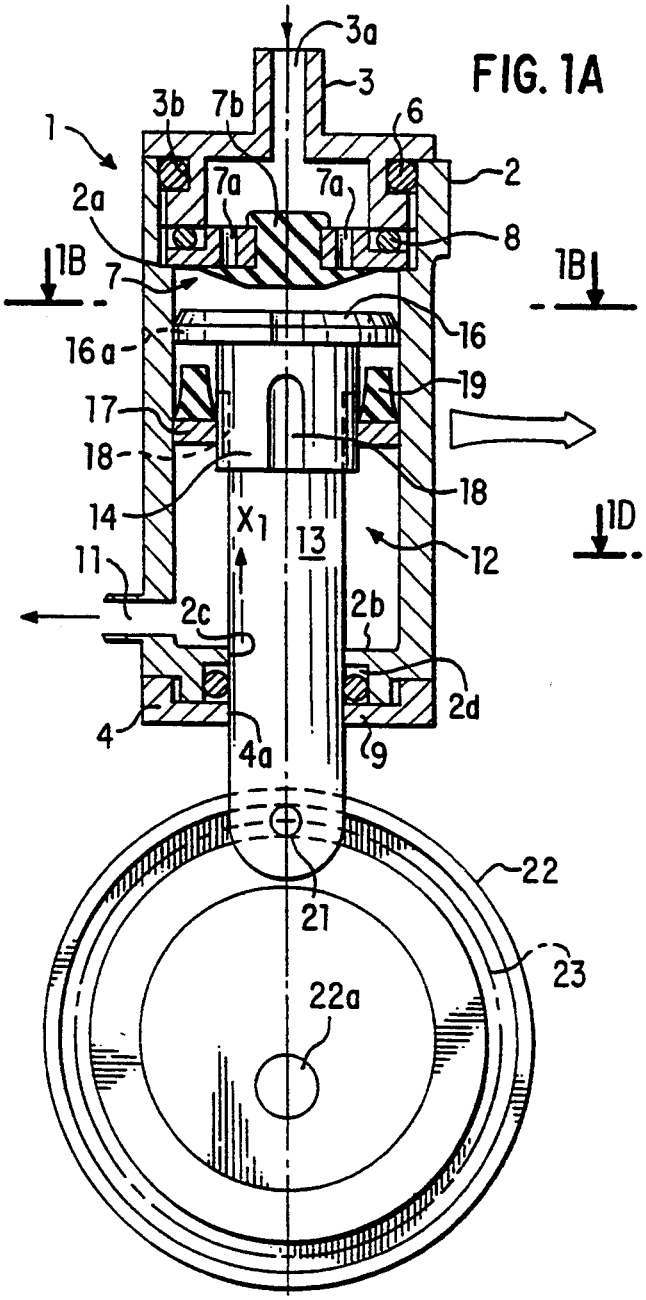
FIG. 1A is a cross sectional view of an entire fluid feed pump when a piston is moving in a fluid moving direction showing a preferred embodiment of the present invention.

Referring first to FIGS. 1A to 1D, there is shown a fluid feed pump to which the present invention is applied when a piston is moving in a fluid moving direction. The fluid feed pump shown includes a hollow cylinder 1 which includes a cylinder body 2, an upper cover 3 for closing an opening at the top end of the cylinder body 2, and a lower cover 4 for closing another opening at the bottom end of the cylinder body 2. The cylinder body 2 has an inner face whose diameter is larger at an upper end portion thereof, and a female thread is formed on the larger diameter inner face at the upper end of the cylinder body 2 while a step 2*a* is formed between the upper end larger diameter inner face and the remaining smaller diameter inner face of the cylinder body 2 below the upper end larger diameter inner face. A bottom wall 2*b* is provided at the bottom end of the cylinder body 2, and a piston passing hole 2*c* is formed at a central portion of the bottom wall 2*b*. An O-snap ring accommodating groove 2*d* of a ring shape is formed on an inner circumferential face of the piston passing hole 2*c*. Further, a male thread is formed on an outer circumferential face of a lower end portion of the cylinder body 2.

An inlet port 3*a* is formed at a central portion of the upper cover 3 and is connected to the inside of a cap which closes up an ink outlet port of an ink jet recording head not shown. An O-snap ring accommodating groove 3*b* of a ring shape is formed on an outer circumferential face of the upper cover 3. A male thread is formed on an outer periphery of a lower end portion of the upper cover 3 and is held in threaded engagement with the female thread at the larger diameter inner face at the upper end of the cylinder body 2. Due to the threaded engagement between them, the cylinder body 2 and the upper cover 3 are coupled to each other. An O-snap ring 6 is accommodated in the O-snap ring accommodating groove 3*b* of the upper cover 3.

A check valve 7 and an O-snap ring 8 are held between the step 2*a* at the upper end inner face of the cylinder body 2 and a lower end face of the upper cover 3.

The check valve 7 has a plurality of fluid passing holes 7*a* formed therein and includes a valve body 7*b* made of a resilient material for allowing fluid to flow only from the upstream side to the downstream side of the fluid passing holes 7*a*. The valve body 7*b* normally closes the lower ends of the fluid passing holes 7*a* due to the resiliency thereof, but when the pressure on the downstream side of the fluid passing holes 7*a* becomes lower than the pressure on the upstream side, the valve body 7*b* is displaced by the difference in pressure to open the lower ends of the fluid passing holes 7*a*.

The female thread of the lower cover 4 is held in threaded engagement with the male thread on the outer circumferential face at the lower end portion of the cylinder body 2. Due to the threaded engagement between them, the cylinder body 2 and the lower cover 4 are coupled to each other. A piston passing hole 4*a* is formed at a central portion of the lower cover 4. The ring-shaped O-snap ring accommodating groove 2*d* at the lower end portion of the cylinder body 2 is closed with an inner face of the lower cover 4, and an O-snap ring 9 is disposed in the thus closed O-snap ring accommodating groove 2*d*.

An outlet hole 11 is formed at a lower end portion of the cylinder body 2 and communicates the inside and the outside of the cylinder 1 with each other.

A piston accommodating chamber is formed in the inside of the cylinder 1 below the check valve 7. A piston 12 is accommodated in the piston accommodating chamber.

The piston 12 has a piston shaft 13 which extends through the piston passing holes 2*c* and 4*a*. A large diameter portion 14 is provided at an upper end portion of the piston shaft 13, and a flange-like suction/discharge contacting portion 16 is formed at the top end of the large diameter portion 14. A plurality of communicating grooves 16*a* are formed on an outer periphery of the suction/discharge contacting portion 16.

A plate-shaped fluid moving contacting element 17 is fitted in and secured to a lower end portion of the large diameter portion 14. A plurality of axially extending fluid moving grooves 18 are formed on an outer periphery at a lower end of the large diameter portion 14.

A tubular enclosing member 19 is disposed between the suction/discharge contacting portion 16 and the fluid moving contacting element 17. The tubular enclosing member 19 is formed so that it has a greater thickness at a lower portion thereof, and a ring-shaped recessed groove 19*a* (refer to FIGS. 1C and 2B) having a V-shaped section is formed on a lower face of the tubular enclosing member 19.

Figure 1C:
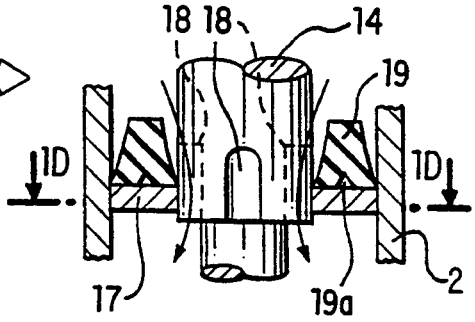
FIG. 1C is a somewhat enlarged cross sectional view of part of the fluid feed pump of FIG. 1A.
Figure 1D:
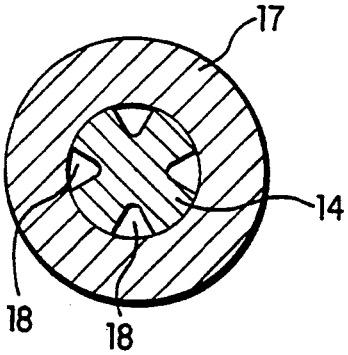
FIG. 1D is a sectional view taken along line ID—ID of FIG. 1C.
Figure 1B:
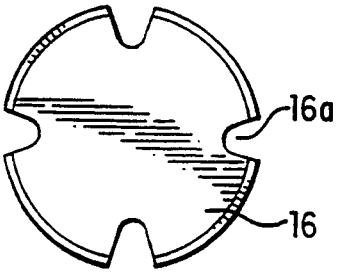
FIG. 1B is a top plan view of a suction/discharge contacting member of the fluid feed pump of FIG. 1A as viewed from line IB—IB of FIG. 1A.

When the tubular enclosing member 19 is positioned in a position shown in FIG. 1 wherein it contacts with the fluid moving contacting element 17, fluid above the enclosing member 19, that is, fluid adjacent the inlet port 3*a*, in the cylinder 1 can move downwardly through the communicating grooves 16*a* and the fluid moving grooves 18 as seen from FIG. 1C.

Figure 2A:
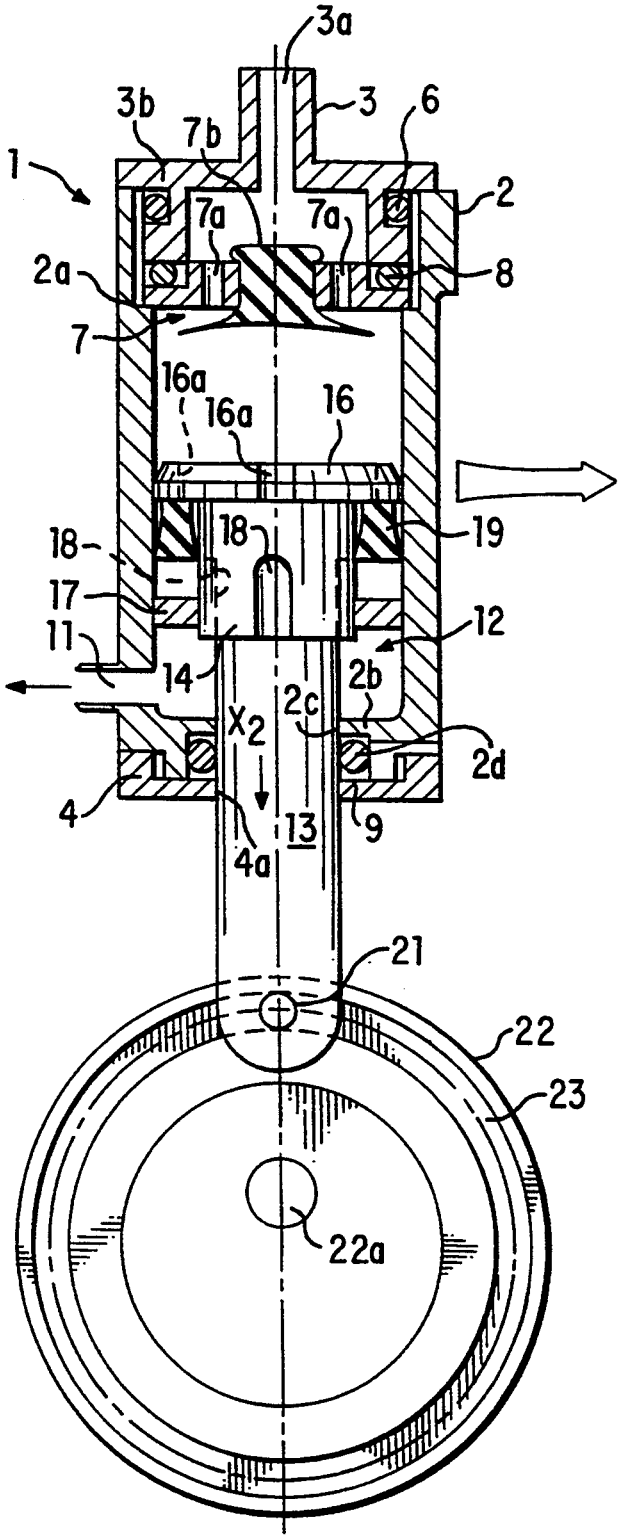
FIG. 2A is a cross sectional view similar to FIG. 1A but when the piston is moving in a sucking/discharging direction.
Figure 2B:
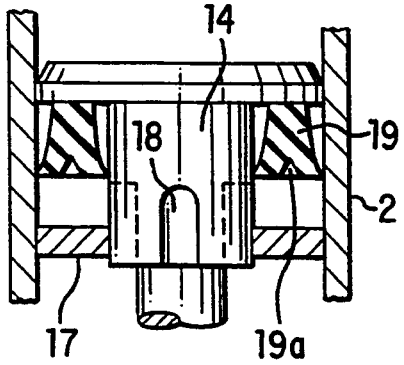
FIG. 2B is a somewhat enlarged cross sectional view of part of the fluid feed pump shown in FIG. 2A.

On the other hand, when the tubular enclosing member 19 is in another position shown in FIG. 2A wherein it contacts with the suction/discharge contacting portion 16, a lower portion of the enclosing member 19 is expanded in a radial direction by the pressure of fluid acting upon the ring-shaped recessed grooves 19*a* at the lower portion of the enclosing member 19, that is, the pressure of fluid adjacent the outlet port 11 in the cylinder 1. Further, the inner face at a lower portion of the enclosing member 19 is closely contacted with the outer circumferential face of the large diameter portion 14 of the piston 12, and the outer face at the lower portion of the enclosing member 19 is closely contacted with the inner face of the cylinder 1. Consequently, the inside of the cylinder 1 is completely separated into an upper section (a section adjacent the inlet port 3*a*) and a lower section (the other section adjacent the outlet port 11) by the enclosing member 19, and fluid will not move between the upper section and the lower section of the inside of the cylinder 1 across the enclosing member 19.

A guide pin 21 is provided at a lower end of the piston rod 13 of the piston 12 and held in engagement with a ring-shaped eccentric cam groove 23 of an eccentric cam plate 22.

When the eccentric cam plate 22 is driven to rotate around an axis of a rotary shaft 22*a* thereof, the guide pin 21 held in engagement with the ring-shaped eccentric cam groove 23 is guided by the eccentric cam groove 23 to move upwardly and downwardly. Thereupon, also the piston rod 13 is moved upwardly and downwardly.

Operation of the fluid feed pump of the embodiment having the construction described above will be described subsequently.

FIG. 1A shows the fluid feed pump in a condition wherein the piston 12 is moving upwardly in the direction indicated by an arrow mark X1, that is, in a fluid moving direction X1. In this condition, the tubular enclosing member 19 moves upwardly together with the fluid moving contacting element 17 while it remains in the condition shown in FIG. 1A wherein it contacts with the fluid moving contacting element 17. Thereupon, fluid above the enclosing member 19, that is, fluid adjacent the inlet port 3*a*, in the cylinder 1 moves downwardly to the lower section adjacent the outlet port 11 in the cylinder 1 through the fluid moving grooves 18 as seen from FIG. 1B.

FIG. 2A shows the fluid feed pump in another condition wherein the piston 12 is moving downwardly in the direction indicated by another arrow mark X2, that is, in a sucking/discharging direction X2. The tubular enclosing member 19 moves downwardly in the direction X2 together with the suction/discharge contacting portion 16 while it remains in the condition shown in FIG. 2A wherein it contacts with the suction/discharge contacting portion 16. Thereupon, as can be seen from FIGS. 2A and 2B, the lower portion of the enclosing member 19 is expanded in a radial direction by the pressure of the fluid below the enclosing member 19, that is, the fluid adjacent the outlet port 11 in the cylinder 1. Then, the inner face of the lower portion of the enclosing member 19 contacts closely with the outer circumferential face of the large diameter portion 14 of the piston 12 while the outer face of the lower portion of the enclosing member 19 contacts closely with the inner face of the cylinder. Consequently, the inside of the cylinder 1 is separated completely into the upper section adjacent the inlet port 3*a* and the lower section adjacent the outlet port 11 by the enclosing member 19. In other words, in the conditions shown in FIGS. 2A and 2B, fluid on the discharging section side will not leak (flow back) into the suction section side.

When the enclosing member 19 moves downwardly, that is, in the sucking/discharging direction X2, the internal volume of the upper section in the cylinder 2 above the enclosing member 19 below the check valve 7 increases, and consequently, the section of the cylinder 2 above the enclosing member 19 below the check valve 7 is put into a negative pressure condition. Consequently, the check valve 7 is put into a communicating condition as seen in FIG. 2A so that ink flows into the upper section above the enclosing member 19 through the inlet ports 3*a* and the check valve 7.

Further, when the enclosing member 19 moves downwardly, the internal volume of the cylinder chamber below the enclosing member 19 decreases, and consequently, ink there is discharged through the outlet port 11.

In the fluid feed pump of the embodiment described above, since the guide pin 21 provided at the lower end of the piston rod 13 is held in engagement with the eccentric cam groove 23 of the eccentric cam plate 22, when the eccentric cam plate 22 rotates, the piston 12 makes back and forth movement on a straight line. The back and forth movement in this instance is mere linear back and forth movement of the piston 12 but does not involve rocking motion of the piston rod 13 which may otherwise be involved when the piston is driven to move back and forth using a crankshaft. Consequently, the structure of the piston driving mechanism is simplified and an ink suction pump of a small size can be constructed readily.

In this manner, with the fluid feed pump of the present embodiment, since the piston 12 only makes linear motion, where the structure wherein the piston 12 extends through the piston passing holes 2*c* and 4*a* is employed, the inner diameters of the piston passing holes 2*c* and 4*a* can be set to a size substantially equal to the outer diameter of the piston 12. As a result, ink in the cylinder 1 can be prevented from leaking to the outside through the piston passing holes 2*c* and 4*a* by means of the lower cover 4 which closes the bottom end of the cylinder 1. In other words, any member disposed around the ink suction pump can be prevented from being soiled by leaking ink.

While the preferred embodiment of the present invention has been described in detail above, the present invention is not limited to the embodiment described above, but many changes and modifications can be made thereto without departing from the spirit and scope of the invention as set forth herein.

For example, the piston shaft 13 of the piston 12 in the embodiment described above can be constituted from a crank arm, and in this instance, the piston head can be moved back and forth using a crankshaft.

Further, it is possible to dispose the check valve 7 below the tubular enclosing member 19, that is, adjacent the outlet port 11. Alternatively, the check valve 7 may be disposed outside the cylinder 1.

What is claimed is:

1. A fluid feed pump, comprising:

a cylinder having an inlet port and an outlet port formed at one and an other end portions thereof and defining a piston accommodating chamber therein between said inlet port and said outlet port;

a piston having a suction/discharge contacting portion and a fluid moving contacting portion disposed in spaced relationship from each other in a axial direction thereof and fitted in said cylinder for reciprocal movement in a sucking/discharging direction and a fluid moving direction opposite to the sucking/discharging direction;

a tubular enclosing member having an upper and lower portion and disposed between an outer circumferential face of said piston and an inner face of said cylinder between said suction/discharge contacting portion and said fluid moving contacting portion, said tubular enclosing member moving in the sucking/discharging direction together with said piston in a condition wherein said upper portion of said tubular enclosing member remains in contact with said suction/discharge contacting portion and in the fluid moving direction together with said piston in another condition wherein said lower portion of said tubular enclosing member remains in contact with said fluid moving contacting portion;

radial expansion means comprising a V-shaped section formed on the lower portion of on the tubular enclosing member for radially expanding said tubular enclosing member so that, when said upper portion of the tubular enclosing member remains in contact with said suction/discharge contacting portion, a fluid pressure from fluid adjacent the outlet port end portion acts to expand the lower portion of the tubular enclosing member in a radial direction so that an outer circumferential face and an inner circumferential face of said expanded lower portion of said tubular enclosing member form a fluid-tight connection with the inner face of said cylinder and the outer circumferential face of said piston and when said lower portion of said tubular enclosing member remains in contact with said fluid moving contacting portion said lower portion of said tubular enclosing member remains in a radially unexpanded shape;

fluid movement controlling means for establishing fluid communication in the axial direction in the inside of said cylinder when said lower portion of said tubular enclosing member is in contact with said fluid moving contacting portion of said piston; and a check valve for allowing movement of fluid into said piston accommodating chamber of said cylinder through said inlet port when said piston moves in the sucking/discharging direction and for preventing fluid from flowing through said inlet port when said piston moves in the fluid moving direction.

2. A fluid feed pump according to claim 1, wherein said fluid movement controlling means comprises the outer circumferential face of the piston which contacts in said fluid-tight connection with the inner circumferential face of said tubular enclosing member when said upper portion of said tubular enclosing member is in contact with said suction/discharge contacting portion of said piston and which has a fluid moving groove which forms a gap between said outer circumferential surface of said piston and the inner circumferential face of said tubular enclosing member when said lower portion of said tubular enclosing member is in contact with said fluid moving contacting portion of said piston.

3. A fluid feed pump according to claim 1, wherein said check valve is disposed between said inlet port and said piston accommodating chamber.

4. A fluid feed pump according to claim 1, wherein said inlet port is connected to an the inside of a cap which closes an ink discharging opening of an ink jet recording head.

* * * * *